US006092046A

United States Patent [19]

Okuda

[11] Patent Number: 6,092,046

[45] Date of Patent: Jul. 18, 2000

[54] SOUND DATA DECODER FOR EFFICIENT USE OF MEMORY

[75] Inventor: Ryosuke Okuda, Hyogo, Japan

[73] Assignee: Mitsubishi Denki Kabushiki Kaisha, Tokyo, Japan

[21] Appl. No.: 08/902,353

[22] Filed: Jul. 29, 1997

[30] Foreign Application Priority Data

Mar. 21, 1997 [JP] Japan ..... 9-067854

[51] Int. Cl.[7] ..... G10L 19/00

[52] U.S. Cl. ..... 704/500; 704/212; 711/5; 711/170

[58] Field of Search ..... 704/212, 500–504, 704/270; 711/5, 170

[56] References Cited

U.S. PATENT DOCUMENTS

| | | | |
|---|---|---|---|
| 4,755,971 | 7/1988 | Jasmer et al. | 365/189.04 |
| 5,381,145 | 1/1995 | Allen et al. | 341/107 |
| 5,521,918 | 5/1996 | Kim | 370/428 |
| 5,642,437 | 6/1997 | Laczko, Sr. et al. | 382/246 |
| 5,845,249 | 12/1998 | Malladi et al. | 704/270 |
| 5,862,175 | 1/1999 | Sugiyama et al. | 375/219 |
| 5,956,674 | 9/1999 | Smyth et al. | 704/229 |

FOREIGN PATENT DOCUMENTS

| | | | |
|---|---|---|---|
| 2-285719 | 11/1990 | Japan | H03M 7/30 |
| 5-134926 | 6/1993 | Japan . | |
| 7-143010 | 6/1995 | Japan . | |

*Primary Examiner*—David R. Hudspeth
*Assistant Examiner*—Abul K. Azad
*Attorney, Agent, or Firm*—McDermott, Will & Emery

[57] ABSTRACT

A sound data decoder is provided which includes a decode portion, a PCM output buffer having a plurality of fractional banks, a bank management portion supplying an address indicating a location of a writable fractional bank to the decode portion, and a PCM output portion reading and outputting, in response to the address, data from a fractional bank corresponding to that address and supplying to the bank management portion an address indicating a location of a fractional bank which is made writable.

7 Claims, 8 Drawing Sheets

SOUND DATA DECODER FOR EFFICIENT USE OF MEMORY

BACKGROUND OF THE INVENTION

1. Field of the Invention

The present invention relates to a sound data decoder decoding digitally compressed sound data.

2. Description of the Background Art

In digital satellite broadcasting, DVDs (Digital Video Disks), and U.S. ATV (Advanced Television), sound data digitalized by Pulse Code Modulation (hereinafter referred to as "PCM", the sound data digitalized by the PCM is called "PCM data") is digitally compressed, for transmitting or recording, by using techniques based on the AC-3 standard of Dolby Laboratories Licensing Corporation or the MPEG (Motion Picture Experts Group) audio standard. In order for users to listen to the sound, a device is necessary which decodes these compressed sound data to original PCM data.

Since sound data is generally compressed by utilizing similarities between PCM data preceding/succeeding in time, a certain number of PCM data, that is, a plurality of PCM data within a certain time width, is collectively encoded. 256 pieces of the PCM data per channel are collectively encoded in the AC-3 standard, whereas 64 pieces per channel are collectively encoded in the MPEG audio standard. This means that 256 or 64 pieces of the PCM data are collectively obtained as a result of decoding. Here, all the PCM data which is collectively obtained is referred to as a "block".

In outputting the PCM data, a decoder generally outputs one piece of the PCM data per channel at a sampling period (1/32000, 1/44100, 1/48000 seconds and so on). This is because the decoder is in most cases directly connected to a D/A converter, requiring that the PCM data be supplied to the D/A converter when each piece of the PCM data is reproduced.

Therefore, the decoder has to output the PCM data of one block while decoding the PCM data of the next block.

FIG. 9 shows a structure of a conventional sound data decoder. As shown in FIG. 9, the sound data decoder includes: a compressed data input portion 1 performing serial/parallel conversion in response to compressed sound data serially transmitted bit by bit; a compressed data input buffer 3 connected to compressed data input portion 1 and having a random access memory (hereinafter referred to as a "RAM") inputting/outputting a word of 16 bits or 32 bits; a decode portion 5 connected to compressed data input buffer 3 and decoding by reading the compressed sound data of one block from compressed data input buffer 3; a PCM output buffer 7 connected to decode portion 5, having a storage capacity for storing two blocks of PCM data, and having a RAM inputting/outputting a word of a bit number corresponding to that of the PCM data; a PCM output portion 9 connected to PCM output buffer 7, reading one piece of the PCM data at a time from PCM output buffer 7, and performing parallel/serial conversion; and a control portion 11 instructing decode portion 5 to start decoding in response to reception of the compressed sound data of at least one block by compressed data input portion 1, and instructing PCM output portion 9 to start outputting the PCM data when decoding of the compressed sound data of one block is completed in decode portion 5.

Let us call a storage region holding one block of PCM data a "bank". Then, PCM output buffer 7 includes two banks 71, 72. When data is written to one bank by decode portion 5, data is read from the other bank by PCM output portion 9. When PCM output portion 9 finishes outputting all PCM data stored in one bank, decode portion 5 and PCM output portion 9 exchange respective banks 71, 72 to or from which data is written or read.

In a conventional sound data decoder structured as above, PCM output buffer 7 is required to have a storage capacity for holding two blocks of PCM data.

For example, decoded PCM data has a precision of 20 bits. In decoding the AC-3 standard data comprised of six channels (left, center, right, left surround, right surround, and Low Frequency Effect channels, of which the Low Frequency Effect channel is called a "super woofer" and it has an extremely narrow frequency band (deep bass), so that it is generally counted as 0.1 channels, storing one block of PCM data (256 pieces of data per channel×6 channels) requires (20 bits×256×6 channels=) 30720 bits or 3840 bytes. Therefore, 7680 bytes, or 2×3840 bytes, are required for the storage capacity of PCM output buffer 7.

Here, the technique for reducing a necessary storage capacity as a whole by dividing a storage region of a buffer memory to control writing and reading for each storage region is disclosed in Japanese Patent Laying-Open No. 2-285719. In this technique, one buffer memory is divided into three regions and two of which store sound data of one sector. When data reading from one region ends, writing the sound data of one sector is started for two regions other than the region which is to be read next.

More specifically, when time required from the start to the end of supplying external input data is represented by W, writing of one block to a buffer memory (requiring time W) is carried out such that it ends simultaneously with the end of the reproducing time period R of the last block. In short, writing of a block starts after time (R-W) since the start of reproducing of the last block. By reusing a region which has been already read out as part of the region to which data is to be written, the storage capacity necessary for the buffer memory is reduced as a whole.

However, if this technique is applied for decoding in the AC-3 standard having six channels, the results are as follows.

A block of data in the AC-3 standard has to be decoded successively for each channel, and a time required for decoding data is approximately the same for each channel. In short, when the time required for reproducing one block is R, data of one channel should be decoded within a time period R/6. Under this condition, data of one channel has to be decoded exactly in R/6 in order to suppress circuit size and power consumption of the decoder as much as possible. In such a decoder, data of one channel is supplied to the output buffer every time period R/6 after the start of decoding. In short, time W from the start to the end of supplying the external input data for one block is at least 5R/6. Therefore, the region which can be reused as a write region is such a region that reading is ended at time R-W ($\leqq$R−5R/6=R/6), that is only ⅙ the region storing data of the last block at most.

If a sound data decoder is formed on one chip, however, the silicon area necessary for implementing a RAM for a PCM output buffer generally has considerable influence on manufacturing cost.

SUMMARY OF THE INVENTION

An object of the present invention is to provide a sound data decoder requiring a smaller storage capacity for a PCM output buffer.

According to one aspect of the present invention, the sound data decoder includes a compressed data input circuit inputting compressed sound data, a decode circuit decoding the sound data input to the compressed data input circuit to generate decoded sound data, a storage circuit having a plurality of storage regions and storing the decoded sound data in the storage regions, and a storage region control circuit reading the decoded sound data stored in one storage region from the storage circuit, and newly storing the decoded sound data for each storage region which is made writable by reading of the decoded sound data.

Therefore, a main advantage of the present invention is, since it includes a storage circuit having a plurality of storage regions and it stores new decoded sound data for each storage region which is made writable by reading of the decoded sound data, that the entire storage capacity required in the storage circuit can be reduced, and manufacturing cost can be cut by reducing the silicon area necessary for forming the storage circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
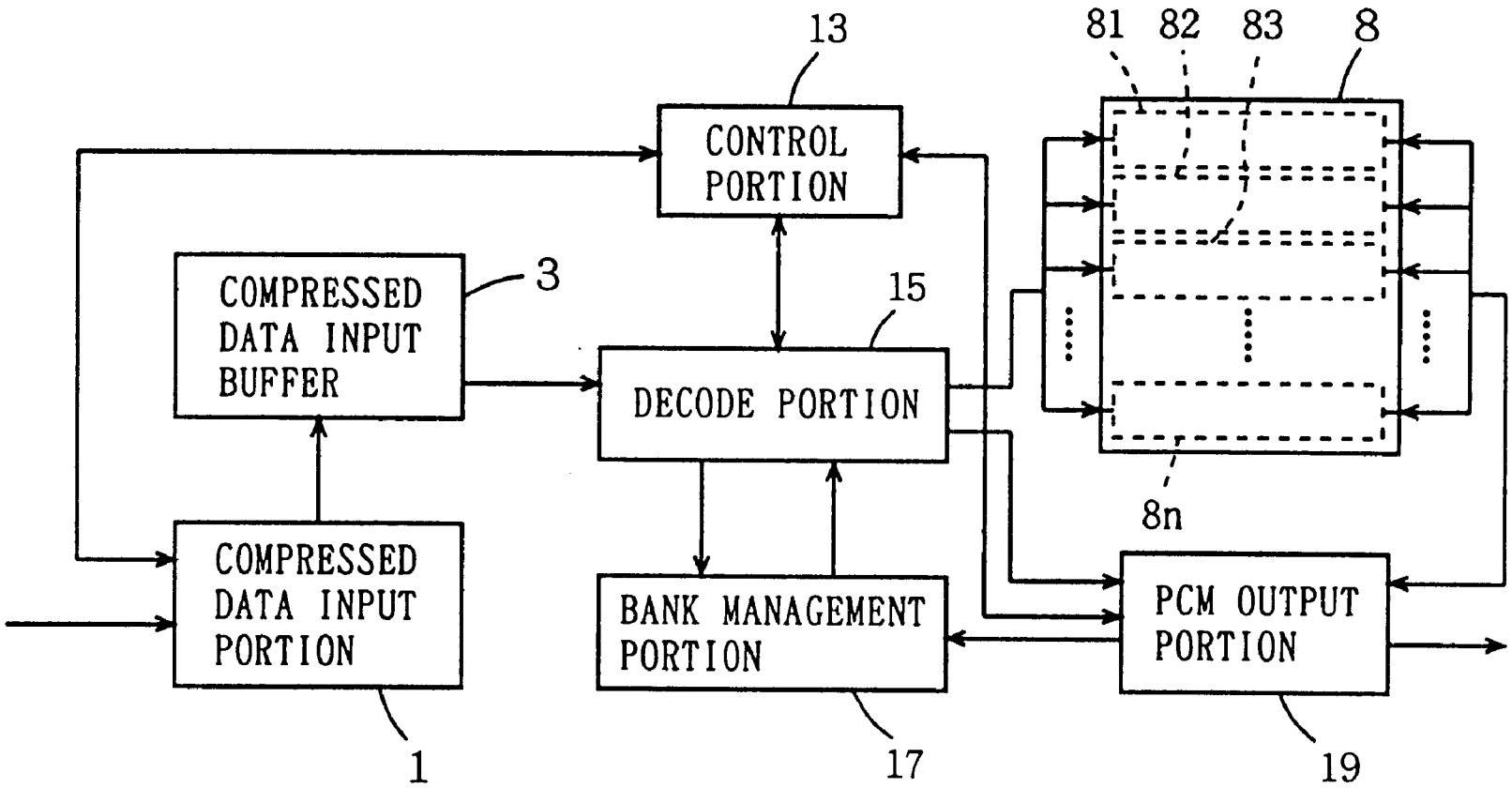
FIG. 1 is a block diagram showing a structure of the sound data decoder in accordance with an embodiment of the present invention.

Here, the embodiment of the present invention will be described in detail with reference to the drawings. The same or corresponding parts throughout the figures are designated by the same reference characters.

While 256 pieces of PCM data per channel are decoded collectively in the AC-3 standard, 64 pieces of PCM data per channel are collectively decoded in the MPEG audio standard. Here, "collectively" means that data of each channel are decoded at one time and not that data of all channels are decoded at one time. For example, assuming that the PCM data having six channels based on the AC-3 standard is decoded, and the time required for decoding one block is T, then 256 pieces of PCM data for one channel are obtained in every time period T/6 since the start of decoding. In short, what is necessary as a storage region for a PCM output buffer is not a region for one block at the time of decode start, but a storage region for storing 256 pieces of the PCM data decoded in every time period T/6.

In other words, the larger the unit for managing the storage region, generally the more inefficient. In the sound data decoder in the prior art above, an entire storage region is managed using, as one unit, a region for storing data of one block or data of 0.5 sectors. Here, when output of the data of one block or one sector is completed, the region for 0.50 blocks or 0.5 sectors out of the entire storage region is already reusable (new data can be written). However, as the management is performed on the basis of each such region, the region cannot be reused until all data stored in the region is completely output.

In the present invention, the entire storage region of the PCM output buffer is divided into smaller regions, and whether they are being used or not is managed on the basis of the smaller region. For example, now a storage region for storing 128 pieces of the PCM data, or a region of a size of (128/(256×6=)1/12 the bank in the conventional sound data decoder is newly referred to as a "fractional" bank. The number of fractional banks necessary for storing a block of PCM data is 12, since two fractional banks are used for one channel.

When the PCM data for a half of one block is completely output, six fractional banks are in an empty state (writable state) and they are reusable.

Assuming that outputting of the PCM data of a certain block (the Nth block) starts at time 0, and the time required for outputting a block of PCM data is T (one of 256/32000 seconds, 256/44100 seconds or 256/48000 seconds), the following Table 1 shows how the number of the fractional banks which are being used varies with the passage of time.

TABLE 1

| Contents fractional bank number | time | | | | | | |
|---|---|---|---|---|---|---|---|
| | 0 | T/6 | T/3 | T/2 | 2T/3 | 5T/6 | T |
| Number of banks storing PCM data of the Nth block | 12 | 12 | 12 | 6 | 6 | 6 | 0 |
| Number of banks storing PCM data of the N + 1th block | 0 | 2 | 4 | 6 | 8 | 10 | 12 |
| Sum of used fractional banks | 12 | 14 | 16 | 12 | 14 | 16 | 12 |

As shown in Table 1, twelve fractional banks are necessary for storing the PCM data of the Nth block from time 0 to immediately before time T/2. At time T/2, 128 pieces of the PCM data of the first half of the block is output for all six channels, so that six fractional banks are empty and only six fractional banks storing the second half of the PCM data for each channel are used. At time T, all PCM data of one block for six channels is completely output, so that the number of fractional banks to be used is 0.

Here, the N+1th block is a block which is currently decoded. Since 256 pieces of the PCM data for one channel are decoded in every time period T/6, two fractional banks are newly required for storing the PCM data.

As shown in Table 1, the sum of the number of fractional banks being used is therefore sixteen at most. When the PCM data with a precision of 20 bits is stored, the storage capacity per bank is (20 bits×128 pieces=) 2560 bits, or 320 bytes. Therefore, the entire storage capacity of the PCM output buffer is (320 bytes×16 banks =) 5120 bytes.

Figure 9:
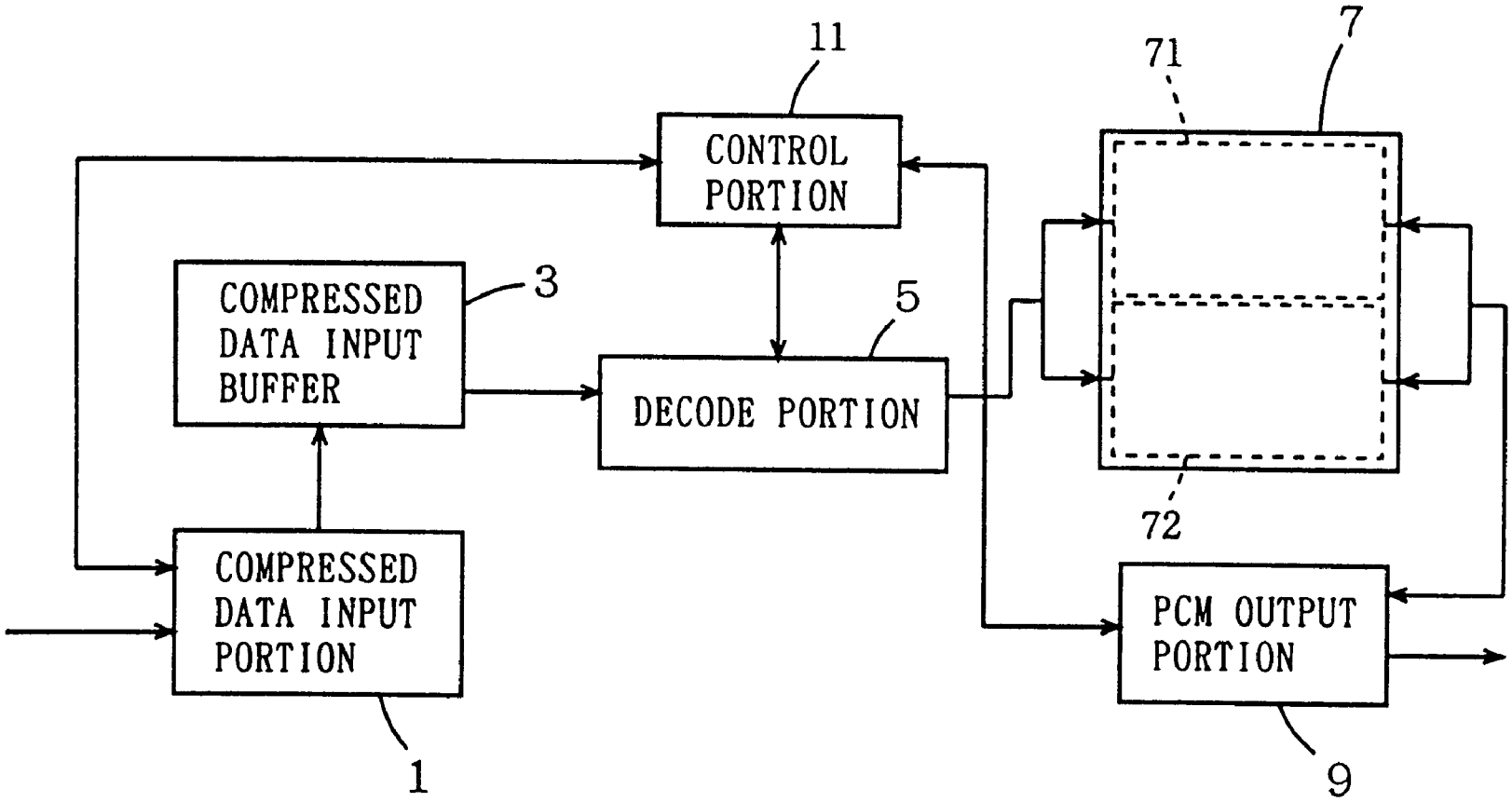
FIG. 9 PRIOR ART
FIG. 9 is a block diagram showing a structure of a conventional sound data decoder.

Since the entire storage capacity required for the PCM output buffer 7 is 7680 bytes in the conventional sound data decoder shown in FIG. 9, the storage capacity can be reduced by 33% in a sound data decoder in accordance with the present invention.

When the prior art described in the above mentioned Japanese Patent Laying Open-No. 2-285719 is applied for decoding based on the AC-3 standard, time W from the start to the end of supplying input data is ⅚ times R which is required for reading data of one block. Therefore, the entire storage capacity which is necessary is (20 bits×256×6 channels×(1+⅚)=)56320 bits or 7040 bytes. The invention can also reduce the storage capacity by 27% as compared to this technique.

FIG. 1 is a block diagram showing a structure of a sound data decoder in accordance with an embodiment of the present invention.

As shown in FIG. 1, the sound data decoder includes: a compressed data input portion 1 inputting digitally compressed serial sound data of six channels and converting it to parallel sound data; a compressed data input buffer 3 connected to compressed data input portion 1 and storing the parallel sound data generated at compressed data input portion 1; a decode portion 15 connected to compressed data input buffer 3 and decoding the parallel sound data stored in compressed data input buffer 3 for each channel; a PCM output buffer 8 having sixteen fractional banks 81 to **8*n* (n=16) each capable of storing 128 pieces of the PCM data, and storing the parallel sound data decoded at decode portion 15 in a writable fractional bank; a bank management portion 17 managing as to whether each one of sixteen fractional banks 81 to 8*n* (n=16) contained in PCM output buffer 8 is currently writable or not; a PCM output portion 19 reading the parallel sound data stored in PCM output buffer 8 to convert it to serial sound data and output it, and supplying an address indicating the location of a fractional bank which is newly made writable to bank management portion 17; and a control portion 13 controlling decode portion 15** and so on.

Next, operation of the sound data decoder in accordance with the embodiment will be described. Immediately after the sound data decoder is activated, all fractional banks 81 to **8*n*** (n=16) are assumed to be writable.

Figure 2:
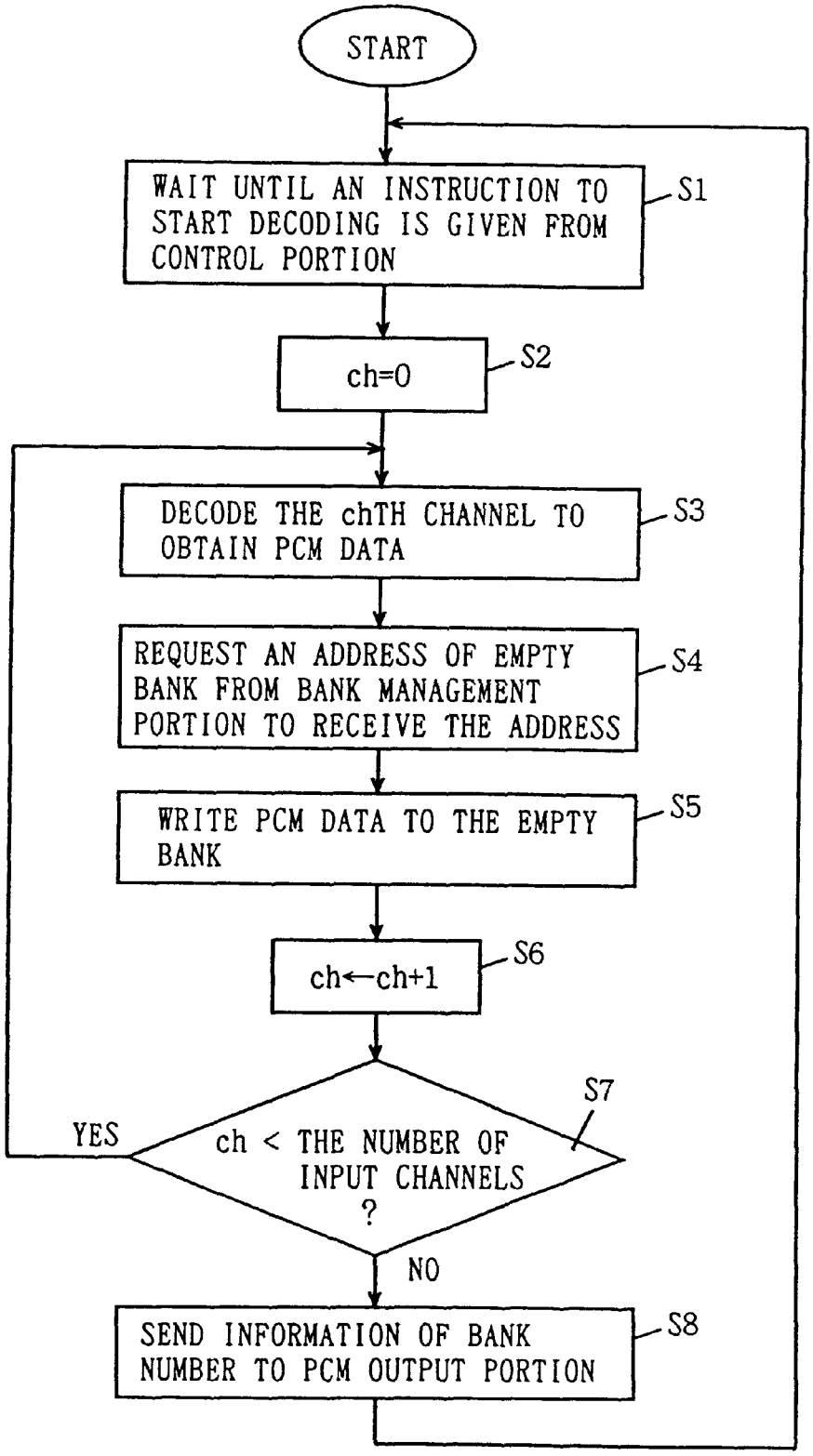
FIG. 2 is a flow chart showing operation of the decode portion shown in FIG. 1.

FIG. 2 is a flow chart showing operation of decode portion 15.

As shown in FIG. 2, decode portion 15 decodes sound data of one channel according to the process from step S3 to step S6, and the process goes from step S8 to step S1 whenever the sound data of one block is decoded.

At step S1, decode portion 15 waits until a decode start signal instructing to start decoding, is supplied from control portion 13. Control portion 13 supplies the decode start signal to decode portion 15 in response to a signal indicating that the sound data of at least one block is received from compressed data input portion 1.

At step S2, the number ch of a channel to be decoded is stored as 0.

At step S3, the sound data of the chth channel is decoded to obtain decoded PCM data.

In order to request notice of the number (address) of an empty fractional bank which is writable, an empty bank request signal is output at step S4 to bank management portion 17, and the number is received. Bank management portion 17 finds two writable fractional banks which are not used in response to the empty bank request signal, and supplies the numbers (addresses) of these empty banks to decode portion 15. If there is not any non-used fractional bank when the empty bank request signal is received, the process waits until fractional banks become empty.

At step S5, the PCM data is written to that writable and empty fractional banks in PCM output buffers, which are indicated from bank management portion 17.

At step S6, the stored channel number is incremented by 1.

At step S7, a determination is made whether the stored channel number ch is smaller than the channel number 6 of the sound data which is to be input to compressed data input portion 1. If the stored channel number ch is smaller than 6, step S3 is entered again. Therefore, the process from step S3 to step S6 is repeated a number of times which corresponds to the number of channels of the sound data which is to be input to compressed data input portion 1, and the empty bank request signal is output from decode portion 15 to bank management portion 17 channel-number times per block.

On the other hand, if the stored channel number ch is not less than 6, the process goes to step S8 in which the number of fractional banks storing the PCM data is informed to PCM output portion 19 for each channel. Then, step S1 is entered again to start decoding the next block.

Figure 3:
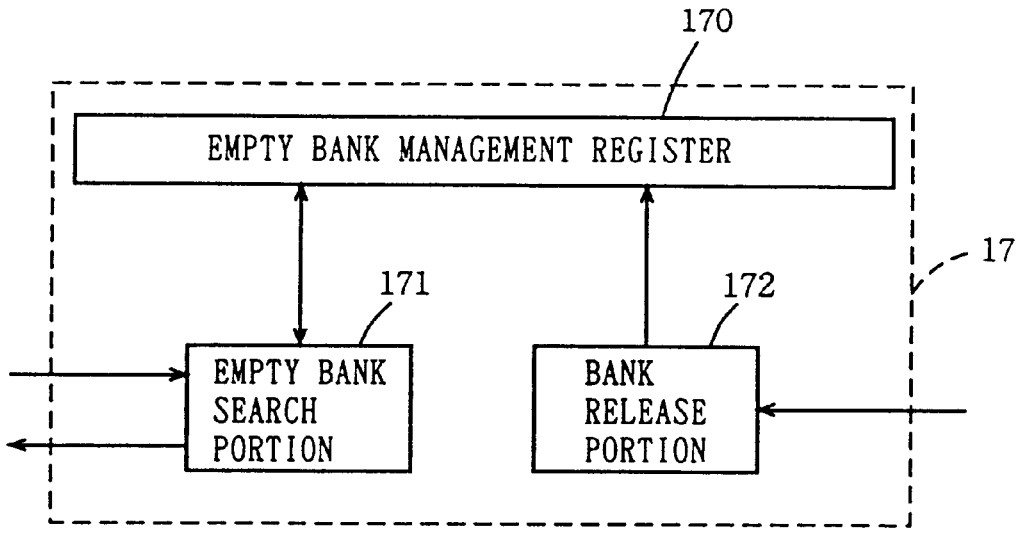
FIG. 3 is a block diagram showing a structure of the bank management portion shown in FIG. 1.

FIG. 3 is a block diagram showing a structure of one bank management portion 17 shown in FIG. 1. As shown in FIG. 3, bank management portion 17 includes an empty bank search portion 171 connected to decode portion 15, a bank release portion 172 connected to PCM output portion 19, and an empty bank management register 170 connected to empty bank search portion 171 and bank release portion 172.

Here, empty bank management register 170 stores information (1 bit) of whether each fractional bank is "used" or "non-used". Since the number of fractional banks is sixteen in the embodiment, the register may be a 16-bit register. It is assumed, for example, that the value of 1 bit being 0 indicates "non-used" and 1 indicates "used".

Empty bank search portion 171 searches, in response to the empty bank request signal from decode portion 15, for two portions in empty bank management register 170 which have the value of 0, and informs decode portion 15 of these locations (corresponding to the bank numbers). At this time, empty bank search portion 171 changes the value of those bits to 1, which correspond to two portions of fractional banks in empty bank management register 170.

Bank release portion 172 receives from PCM output portion 19 a bank release request signal indicating the number of a bank which is non-used, and changes the bit value 1 to 0 of the location of the number of empty bank management register 170.

Figure 4:
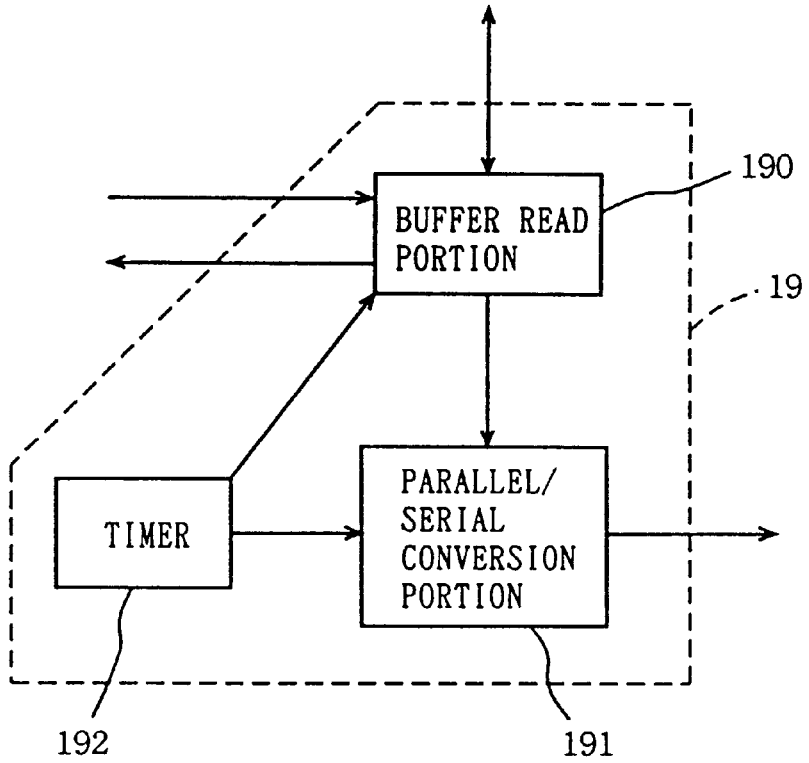
FIG. 4 is a block diagram showing a structure of the PCM output portion shown in FIG. 1.

FIG. 4 is a block diagram showing a structure of PCM output portion 19 shown in FIG. 1. As shown in FIG. 4, PCM output portion 19 includes a buffer read portion 190 connected to PCM output buffer 8, decode portion 15 and bank management portion 17, a parallel/serial conversion portion 191 connected to buffer read portion 190, and a timer 192 connected to buffer read portion 190 and parallel/serial conversion portion 191.

Timer 192 supplies respective periodic signals to buffer read portion 190 and parallel/serial conversion portion 191 at a sampling period.

Buffer read portion 190 receives, for storing, the number of fractional banks storing the PCM data for each channel from decode portion 15, and reads the PCM data from the fractional banks corresponding to the stored numbers whenever the periodic signal is supplied from timer 192, and transfers the data to parallel/serial conversion portion 191. When all 128 PCM data stored in one fractional bank are read out, buffer read portion 190 supplies the numbers of those fractional banks as a bank release request signal to bank release portion 172 contained in bank management portion 17. This reading operation is performed for all channels.

In response to the periodic signal from timer 192, parallel/serial conversion portion 191 receives parallel PCM data of all channels from buffer read portion 190, and outputs the sound data bit by bit serially.

Control portion 13, decode portion 15 and bank management portion 17 shown in FIG. 1 do not have to be implemented with respective specialized hardware. If similar functions are described in software, it is also possible to implement the functions by a central processing unit (hereinafter referred to as "CPU").

Figure 5:
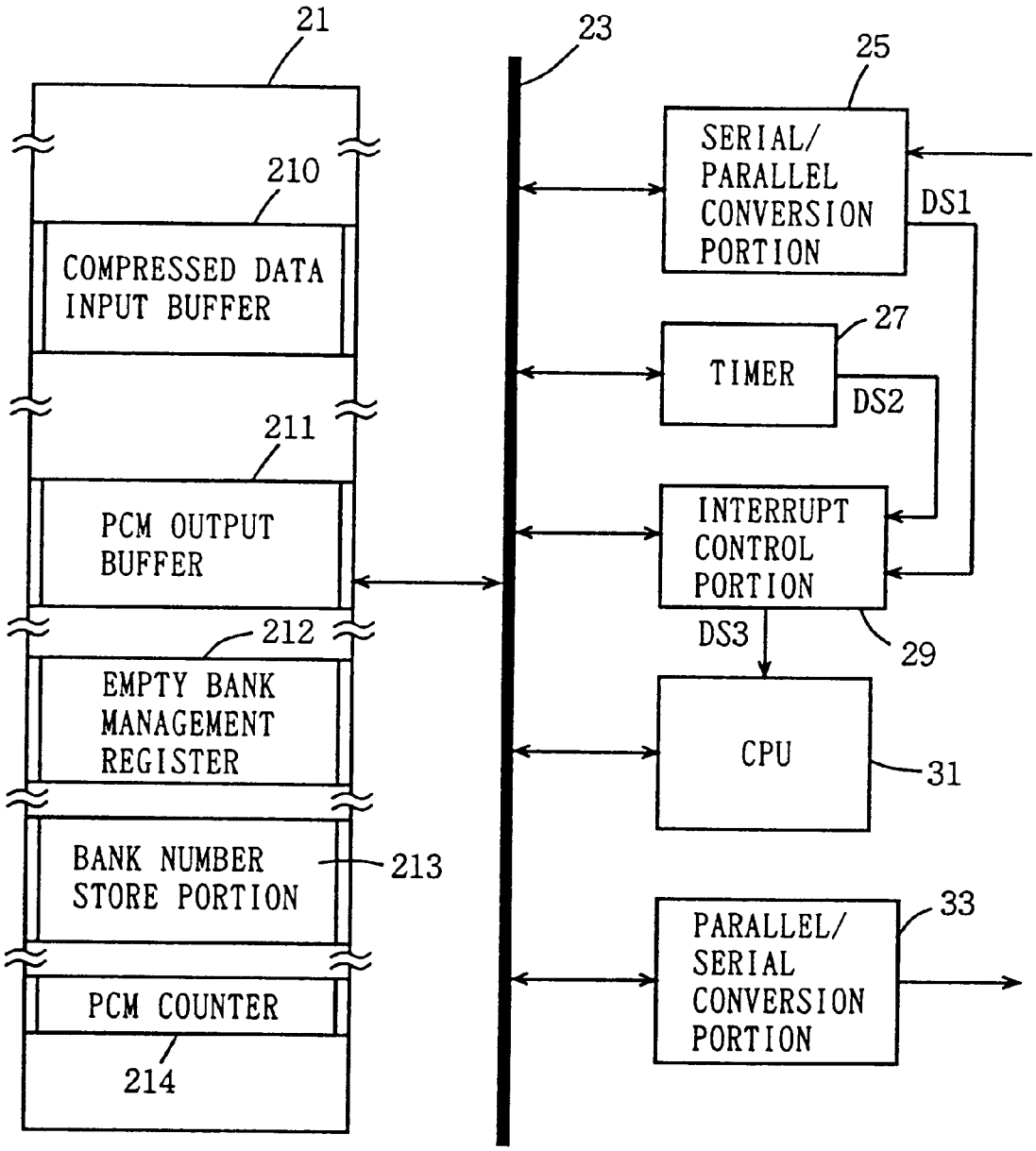
FIG. 5 is a block diagram showing a structure of a sound data decoder including a CPU in accordance with the embodiment of the present invention.

FIG. 5 shows a structure of a sound data decoder including a CPU 31. As shown in FIG. 5, the sound data decoder includes: a data bus 23; a RAM 21 connected to data bus 23 and having a compressed data input buffer 210, a PCM output buffer 211, an empty bank management register 212, a bank number store portion 213, a PCM counter 214 and so on; a serial/parallel conversion portion 25 connected to data bus 23; a timer 27; an interrupt control portion 29 connected to data bus 23, serial/parallel conversion portion 25 and timer 27; CPU 31 connected to data bus 23 and interrupt control portion 29; and a parallel/serial conversion portion 33 connected to data bus 23.

Here, all functions except that of storing the number of an empty fractional banks in bank management portion 17 shown in FIG. 1 are implemented by the software, that is, CPU 31.

The function of compressed data input portion 1 shown in FIG. 1 is implemented by serial/parallel conversion portion 25, and the function of supplementing it is implemented by the software.

Other functions in PCM output portion 19 shown in FIG. 1, except those of built-in timer 192 and parallel/serial conversion portion 191, are all implemented by the software.

When serial/parallel conversion portion 25 shown in FIG. 5 receives a certain bit number (16 bit for example) of the compressed sound data which is serially input bit by bit, it outputs an interrupt signal DS1 to interrupt control portion 29.

Timer 27 outputs an interrupt signal DS2 to interrupt control portion 29 at a sampling period.

When interrupt signals DS1, DS2 are supplied from serial/parallel conversion portion 25 or timer 27, interrupt control portion 29 outputs an interrupt signal DS3 to CPU 31.

When CPU 31 receives interrupt signal DS3 from interrupt control portion 29, it asks interrupt control portion 29 through data bus 23 where interrupt signals DS1, DS2 are generated. Accordingly, interrupt control portion 29 supplies information indicating from which serial/parallel conversion portion 25 or timer 27 interrupt signals DS1, DS2 are generated, to CPU 31 through data bus 23.

When interrupt signal DS3 is supplied, CPU 31 temporarily stops its process such as currently performed decoding, and starts processing a program called an "interrupt handler".

Figure 6:
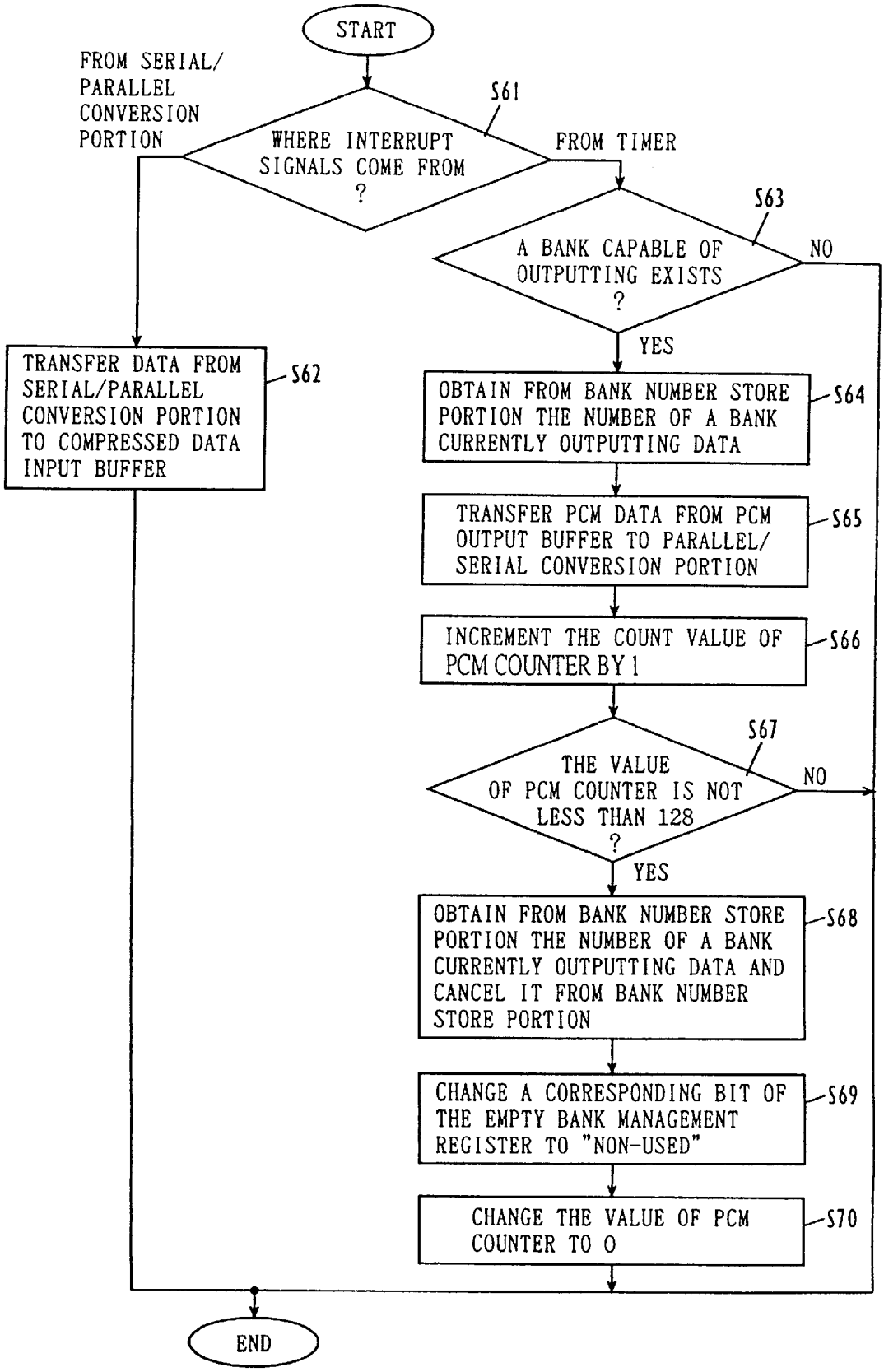
FIG. 6 is a flow chart showing an interrupt handler process in the sound data decoder shown in FIG. 5.

FIG. 6 is a flow chart showing a process of the interrupt handler.

As shown in FIG. 6, at step S61, interrupt control portion 29 is asked through data bus 23 where interrupt signals DS1, DS2 are generated, as described above.

If interrupt signal DS1 is generated at serial/parallel conversion portion 25, step S2 is entered. At step S62, sound data (16 bits for example) is read from serial/parallel conversion portion 25 and transferred to compressed data input buffer 210 contained in RAM 21. Thus, the interrupt handler process is ended.

If interrupt signal DS2 is generated at timer 27, step S63 is entered where a determination is made whether a fractional bank capable of outputting the PCM data exists or not. This determination is made by CPU 31 which asks bank number store portion 213 contained in RAM 21. Here, bank number store portion 213 is assumed not to store any number of the fractional bank as an initial value. In this case, the interrupt handler process is immediately ended.

If there is a fractional bank capable of outputting, and the number of a fractional bank storing the PCM data is written in bank number store portion 123, step S64 is entered where the number (address) of the fractional bank storing all channels currently outputting data is used from bank number store portion 213.

At step S65, the PCM data in a location designated by PCM counter 214 is transferred through data bus 23 from the fractional bank (contained in PCM output buffer 211) designated by the number of the fractional bank which is read to parallel/serial conversion portion 33. Here, parallel/serial conversion portion 33 begins to output the transferred PCM data.

At step S66, the count value of PCM counter 214 is incremented by 1. This count value represents the number of the PCM data output from the fractional bank which is currently outputting, with an initial value being 0.

In the embodiment, 128 PCM data is stored in one fractional bank. Therefore, a determination is made whether the count value of PCM counter 214 is not less than 128 at step S67.

If the count value is less than 128, the interrupt handler process is ended. On the other hand, if the count value becomes 128, step S68 is entered. When the count value of PCM counter 214 is 128, all PCM data stored in one fractional bank have been read out. At step S68, the number of the fractional bank currently outputting data is thus canceled in bank number store portion 213, making a corresponding bit of empty bank management register 212 "non-used", that is, 1 to 0, at step S69.

At step S70, the value of PCM counter 214 returns to 0. Thus, the interrupt handler process is ended.

When the interrupt handler ends, CPU 31 goes back to its essential process.

Figure 7:
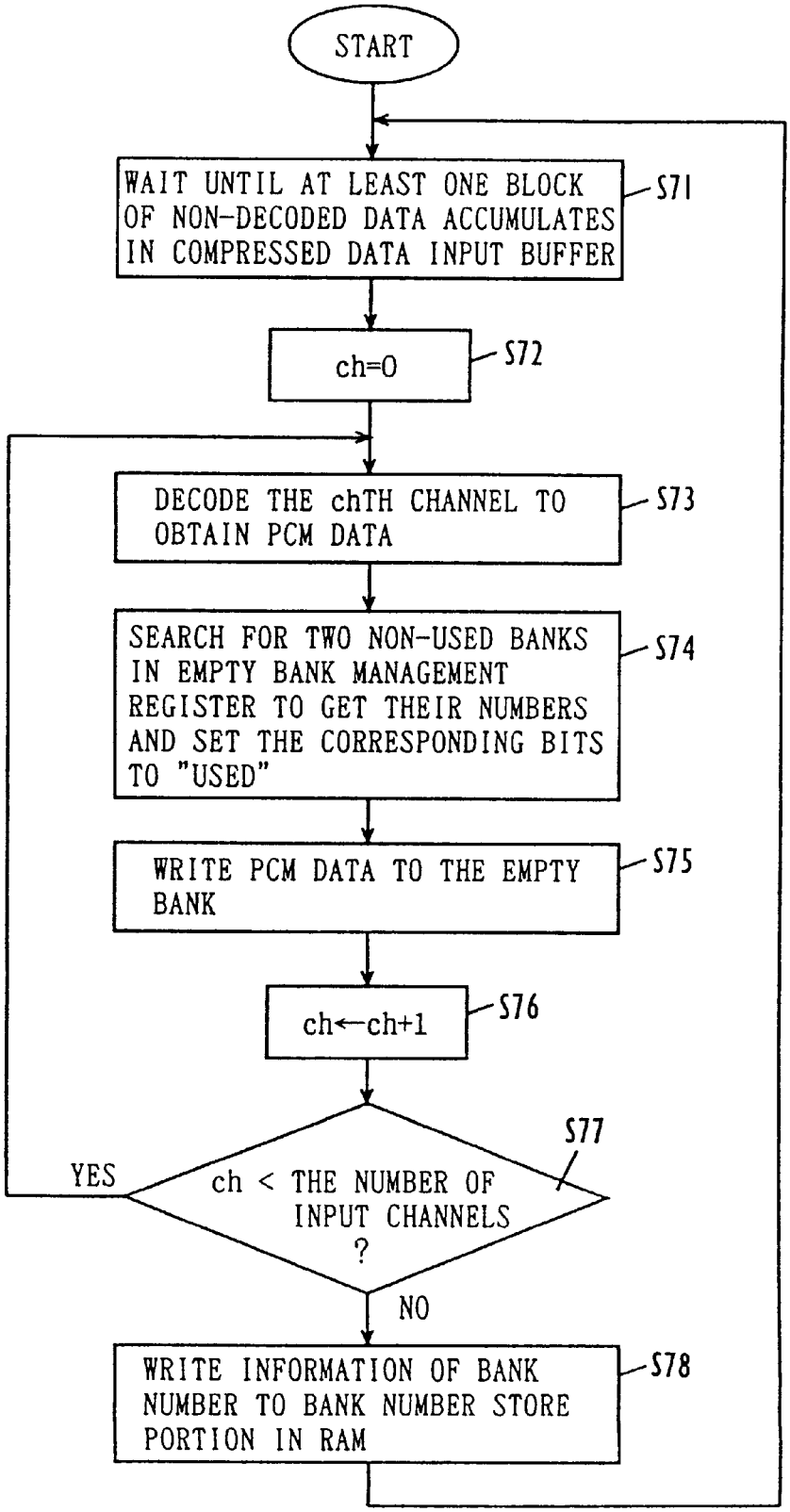
FIG. 7 is a flow chart showing an essential process of the CPU shown in FIG. 5.

FIG. 7 is a flow chart showing an essential process of CPU 31.

At step S71, the process waits until data of at least one block, which is not decoded, is accumulated in compressed data input buffer 210. When the compressed data is externally input to serial/parallel conversion portion 25, and the compressed data of at least one block is accumulated in compressed data input buffer 210 by the interrupt handler, step S72 is entered where the number ch of a channel to be stored is set to 0.

Then, the chth channel is decoded at step S73. At step S74, CPU 31 searches for two fractional banks which are "non-used" in empty bank management register 212 to obtain the numbers and sets them to "used"(sets corresponding bits 0 to 1).

At step S75, the decoded PCM data is written to two empty fractional banks which were searched.

At step S76, the channel number ch to be stored is incremented by 1.

At step S77, a determination is made whether the stored channel number ch is smaller than the channel number (6in the embodiment) contained in the sound data to be input to serial/parallel conversion portion 25, and the process goes back to step S73 when the channel number is smaller. On the other hand, if the stored channel number ch is 6, step S78 is entered where the number of a fractional bank to which the decoded PCM data has been written is written for each channel to bank number store portion 213 contained in RAM 21.

By the process up to step S78, the PCM data of all channels is written to PCM output buffer 211 for a certain block, and the number of used fractional banks has been orderly written for each channel to bank number store portion 213.

After the process of step S78, step S71 is entered again to start processing data of the next one block.

Operation of the sound data decoder shown in FIG. 5 has been described above. Numerous equivalent variations can be made as a whole as the process of the interrupt handler, and FIG. 8 shows one example.

Figure 8:
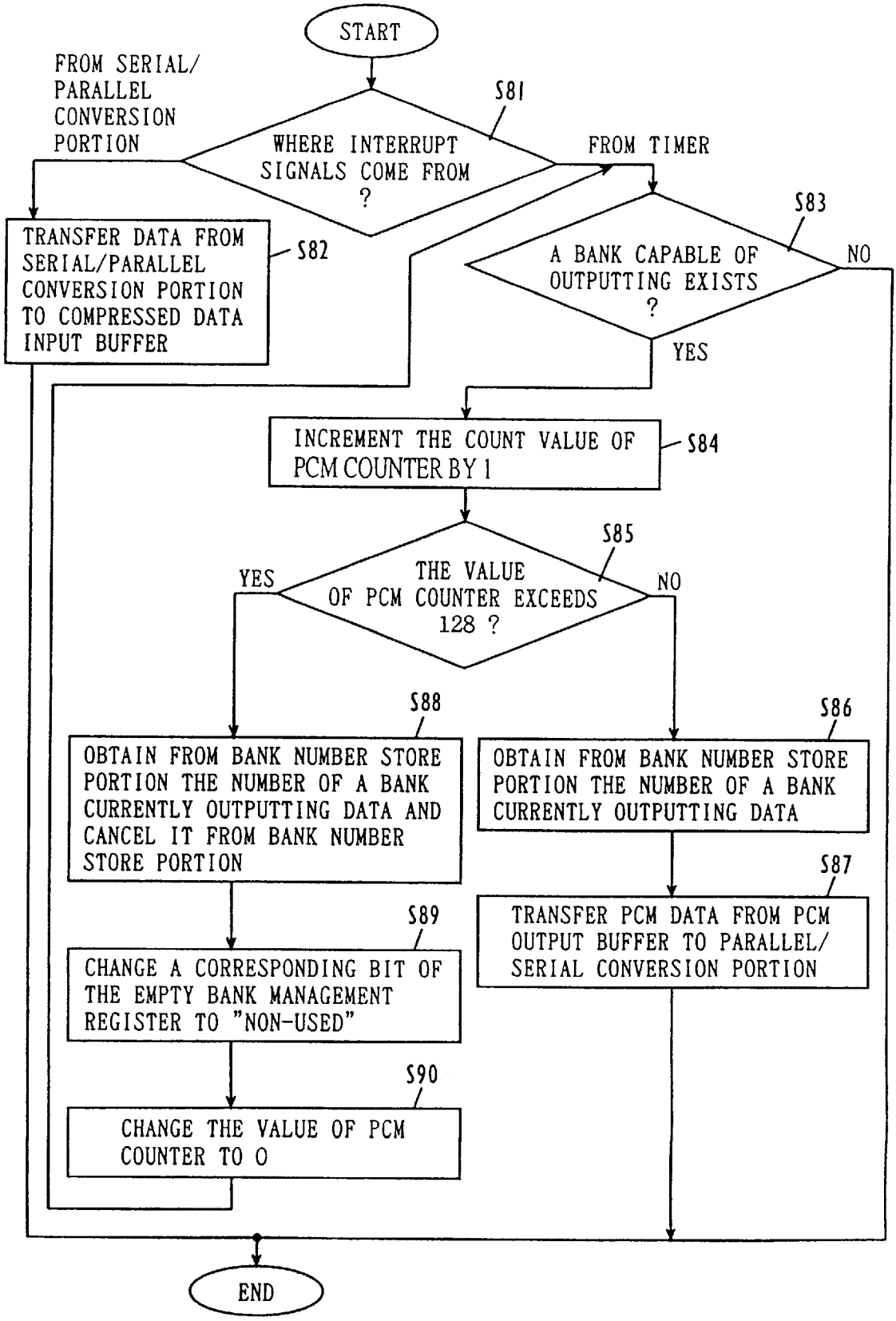
FIG. 8 is a flow chart showing another example of the interrupt handler process in the sound data decoder shown in FIG. 5.

Although the interrupt handler process shown in FIG. 8 is similar to that of FIG. 6, the following differences are found.

In the process shown in FIG. 8, a determination is made at step 3 whether a fractional bank capable of outputting exists, and then the count value of PCM counter 14 is first incremented by 1 at step S84. Then, the subsequent process is carried out after determining whether the value of PCM counter 214 exceeds 128 or not at step S85.

While one fractional bank stores 128 PCM data in the description above, a sound data decoder whose PCM data stores a different number of PCM data may operate likewise.

The following Table shows how the number of banks being used varies with the passage of time if one fractional bank stores, for example, 64 PCM data.

TABLE 2

| Contents of fractional bank number | time | | | | | | | | |
|---|---|---|---|---|---|---|---|---|---|
| | 0 | T/6 | T/4 | T/3 | T/2 | 2T/3 | 3T/4 | 5T/6 | T |
| Number of banks storing PCM data of the Nth block | 24 | 24 | 18 | 18 | 12 | 12 | 6 | 6 | 0 |
| Number of banks storing PCM data of the N + 1th block | 0 | 4 | 4 | 8 | 12 | 16 | 16 | 20 | 24 |
| Sum of used fractional banks | 24 | 28 | 22 | 26 | 24 | 28 | 22 | 26 | 24 |

In this case, 28 fractional banks are sufficient as shown in Table 2, so that the entire storage capacity which is required is (20 bits×64×28 banks=) 35840 bits or 4480 bytes. It is a reduction of about 42% from the entire storage capacity of 7680 bytes necessary for the conventional sound data decoder shown in FIG. 9.

However, it is difficult to manage the fractional bank if it has such a small storage capacity.

As described above, according to the sound data decoder in accordance with the embodiment, empty fractional banks are searched channel-number times per data of one block, and fractional banks are made writable (channel numbers× NB) times if the number of fractional banks required for storing data of one channel is NB. Therefore, the storage region which is made writable by reading can be reused more efficiently than in the prior art, and the effect of reducing the entire storage capacity necessary for PCM output buffers 8, 211 can be greater.

In the AC-3 standard sound data decoder, a function of delaying reproduction may be required only for surround and center channels. This is because the reproduction time is adjusted so that a listener can listen to sound simultaneously from all speakers, when speakers corresponding to the surround and center channels are located physically closer to the listener than other speakers corresponding to other channels. Specifically, the delay time in this case is, for example, approximately 15 m seconds at most and it corresponds to the time of the 720 PCM data if the sampling frequency is 48 kHz. Such a function is implemented by delaying the timing of reading the PCM data from PCM output buffers 8, 211 only for the surround and center channels. Although the number of fractional banks necessary for PCM output buffers 8, 211 is slightly increased in this case, it is apparent that this function can be essentially implemented by managing the fractional banks as described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sound data decoding device, comprising:

input means for inputting plural channels of compressed sound data;

decoding means for decoding the sound data from said input means for each channel and generating an empty bank request signal each time when finishing to decode each channel of sound data;

a memory being divided into a plurality of banks for storing the sound data decoded by said decoding means;

output means for reading and outputting the sound data from said memory for each channel and generating a bank release request signal each time when finishing to read the each channel of sound data; and managing means for managing whether each said bank is used or non-used, informing said decoding means of a non-used bank among said plurality of banks in response to said empty bank request signal to control said memory so that the each channel of decoded sound data is written in the non-used bank and regarding the bank from which said each channel of sound data is read by said output means as a non-used bank in response to said bank release request signal.

2. The sound data decoding device according to claim 1, wherein said managing means includes:

an empty bank management register storing information indicating whether each said bank is used or non-used, empty bank searching means responsive to said empty bank request signal for searching a non-used bank based on said empty bank management register and informing said decoding means of the searched non-used bank, and bank release means responsive to said bank release request signal for changing information in said empty bank management register corresponding to the bank from which said each channel of sound data is read by said output means into non-used.

3. The sound data decoding device according to claim 1, wherein two or more banks are assigned to the each channel.

4. The sound data decoding device according to claim 1, further comprising an input buffer storing the sound data from said input means and providing said decoding means with the sound data.

5. The sound data decoding device according to claim 1, further comprising control means for generating a decode start signal for starting said decoding means and providing said decoding means with the decode start signal.

6. The sound data decoding device according to claim 1, wherein said input means converts serial sound data into parallel sound data, and said output means includes:

reading means for reading the parallel sound data for each channel from said memory, and parallel to serial converting means for converting all the channels of parallel sound data read by said reading means into the serial sound data.

7. The sound data decoding device according to claim 6, wherein said output means further includes a timer generating a periodic signal, and said reading and parallel to serial converting means are responsive to said periodic signal.

* * * * *